US009623668B2

(12) United States Patent
Ohnishi

(10) Patent No.: US 9,623,668 B2
(45) Date of Patent: Apr. 18, 2017

(54) INKJET PRINTING DEVICE AND LIQUID SUPPLYING DEVICE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/650,866

(22) PCT Filed: Dec. 16, 2013

(86) PCT No.: PCT/JP2013/083589
§ 371 (c)(1),
(2) Date: Jun. 9, 2015

(87) PCT Pub. No.: WO2014/098018
PCT Pub. Date: Jun. 26, 2014

(65) Prior Publication Data

US 2015/0328899 A1 Nov. 19, 2015

(30) Foreign Application Priority Data

Dec. 17, 2012 (JP) ..... 2012-275143

(51) Int. Cl.
*B41J 2/175* (2006.01)

(52) U.S. Cl.
CPC ..... *B41J 2/17566* (2013.01); *B41J 2/17513* (2013.01); *B41J 2/17556* (2013.01); *B41J 2/17596* (2013.01); *B41J 2002/17516* (2013.01); *B41J 2002/17586* (2013.01)

(58) Field of Classification Search
None
See application file for complete search history.

(56) References Cited

U.S. PATENT DOCUMENTS 6,183,076 B1 * 2/2001 Childers ..... B41J 2/04543 347/86
2004/0178106 A1 * 9/2004 Morita ..... B41J 2/17513 206/459.1

FOREIGN PATENT DOCUMENTS

| | | |
|---|---|---|
| JP | 2001-162834 | 6/2001 |
| JP | 2001-353881 | 12/2001 |
| JP | 2003-159811 | 6/2003 |
| JP | 2006-021380 | 1/2006 |

(Continued)

OTHER PUBLICATIONS

"First Office Action of China Counterpart Application", issued on Jan. 25, 2016, pp. 1-16, with English translation thereof.

(Continued)

*Primary Examiner* — Justin Seo
(74) *Attorney, Agent, or Firm* — Jianq Chyun IP Office

(57) ABSTRACT

The object is to provide a printing device with a superior gas barrier property in an ink supplying passage. As a solution therefor, an ink supplying unit (10) of an inkjet printing device (100) includes a pressure chamber (11) connected to a supplying passage (21). The pressure chamber (11) is formed of a resin material having a superior gas barrier property, and can be warped by a biasing force in a direction along which a distance between opposing inner walls thereof is increased so as to be able to set an inside of the ink supplying passage to a negative pressure.

10 Claims, 9 Drawing Sheets

(56) References Cited

FOREIGN PATENT DOCUMENTS

| | | |
|---|---|---|
| JP | 2009-279878 | 12/2009 |
| JP | 2011-016348 | 1/2011 |
| WO | 03041964 | 5/2003 |
| WO | 2008102657 | 8/2008 |

OTHER PUBLICATIONS

"International Search Report (Form PCT/ISA/210)", mailed on Mar. 18, 2014, with English translation thereof, pp. 1-4.
"Office Action of Japan Counterpart Application", issued on Sep. 20, 2016, p. 1-p. 8, with English translation thereof.

* cited by examiner

INKJET PRINTING DEVICE AND LIQUID SUPPLYING DEVICE

CROSS-REFERENCE TO RELATED APPLICATION

This application is a 371 application of an international PCT application serial no. PCT/JP 2013/083589, filed on Dec. 16, 2013, which claims the priority benefit of Japan application no. JP 2012-275143, filed on Dec. 17, 2012. The entirety of each of the abovementioned patent applications is hereby incorporated by reference herein and made a part of this specification.

TECHNICAL FIELD

The present invention relates to an inkjet printing device and a liquid supplying device.

BACKGROUND ART

In an inkjet printing device, it is known to set a pressure in an ink passage within a liquid jetting head to a negative pressure, so as to jet out liquid from the liquid jetting head. As an example of such an inkjet printing device, a liquid jetting device as described in Patent Document 1 can be exemplified.

PRIOR ART DOCUMENT

Patent Document

Patent Document 1: International Publication Gazette WO 03/041964 pamphlet (published on May 22, 2003).

SUMMARY OF THE INVENTION

Problem to be Solved by the Invention

The liquid jetting device described in Patent Document 1 is provided with a valve unit that uses a flexible film member that is displaced based on the negative pressure generated accompanying a reduction of liquid in the pressure chamber, and controls a liquid supply to a pressure chamber from a liquid container body by opening and closing a supplying passage by the displacement of the film member.

However, the flexible film member used in the liquid jetting device described in Patent Document 1 has a low gas barrier property (air tightness), and there has been a problem that ink could not be jetted out due to a cavitation (phenomenon in which air dissolved in the ink turns into bubbles, and the ink cannot be jetted out) being generated inside the liquid jetting head.

The present invention has been made in view of the above problem, and its aim is to provide an inkjet printing device and a liquid supplying device having a superior gas barrier property in the ink supplying passage in the liquid jetting head.

Solutions to the Problem

To solve the above problem, an inkjet printing device according to the present invention is characteristic in including a liquid supplying unit that supplies liquid to a liquid jetting head configured to discharge the liquid onto a medium, wherein the liquid supplying unit includes: a pressure chamber that is connected to a supplying passage connecting a liquid container storing liquid and the liquid jetting head, stores therein the liquid from the liquid container, and supplies the liquid to the liquid jetting head; a valve provided on the supplying passage between the liquid container and the pressure chamber so as to open and close the supplying passage; and a negative pressure generating unit that applies a biasing force in a direction along which a distance between opposing inner walls of the pressure chamber is increased, and the pressure chamber is a bag-shaped member that is formed of a resin material of which wall surface is displaced accompanying a change in a liquid amount stored inside.

According to the above configuration, the liquid supplying unit supplies the liquid inside the liquid container to the liquid jetting head. The liquid container and the liquid jetting head are connected through the supplying passage. The supplying passage is connected to the pressure chamber for storing therein the liquid, and the valve provided between the liquid container and the pressure chamber opens and closes the supplying passage so that the liquid inside the liquid container is supplied to the pressure chamber.

The pressure chamber is applied with the biasing force in the direction along which the distance between opposing inner walls is increased by the negative pressure generating unit. The pressure chamber is a bag-shaped member that is formed of the resin material, of which wall surface is displaced accompanying the change in the liquid amount stored inside. Further, the pressure chamber is warped so that the distance between the inner walls increases by the biasing force applied by the negative pressure generating unit. Due to this, the inside of the pressure chamber comes to be of the negative pressure, and the inside of the supplying passage connected to the pressure chamber comes to be of the negative pressure. Accordingly, the liquid is jetted out from the liquid jetting head by making the inside of the supplying passage for supplying the liquid to the liquid jetting head be at a negative pressure by the liquid supplying unit.

The resin material that forms the pressure chamber has a superior gas barrier property; thus, in accordance with the inkjet printing device according to the present invention, the occurrence of the cavitation in the liquid jetting head is reduced, and a jetting performance of the liquid jetting head can be stabilized. Further, since the resin material that forms the pressure chamber is inexpensive, a low-cost inkjet printing device can be provided.

Further, the inkjet printing device according to the present invention preferably further includes: a pressure detecting unit that detects a pressure within the supplying passage; and a control unit that determines that a liquid amount inside the liquid container is less than a predetermined amount when the pressure within the supplying passage detected by the pressure detecting unit becomes less than a predetermined pressure.

According to the above configuration, the pressure in the supplying passage for supplying the liquid to the liquid jetting head is detected by the pressure detecting unit. Then, the control unit detects the liquid amount inside the liquid container based on the pressure detected by the pressure detecting unit. That is, the control unit determines that the remaining amount of the liquid inside the liquid container has become less than the predetermined amount when the pressure detected by the pressure detecting unit becomes less than the predetermined pressure.

In this way, the remaining amount of the liquid inside the liquid container can be detected by detecting the pressure of the liquid in the supplying passage. Accordingly, when the control unit has determined that the remaining amount of the liquid inside the liquid container has become less than the predetermined amount, switching may be performed so that the liquid may be supplied to the liquid jetting head from a spare liquid container, or replacement of the liquid container may be notified to a user so that an occurrence of a defective printing caused by a run-out of ink can be prevented, even during a time-consuming and continuous printing.

Further, in the inkjet printing device according to the present invention, preferably the pressure detecting unit includes a capacity detector that detects a displacement of the wall surface of the pressure chamber, and the pressure within the supplying passage is detected by detecting the displacement of the wall surface of the pressure chamber detected by the capacity detector.

According to the above configuration, the pressure detecting unit detects the pressure inside the supplying passage by detecting the displacement of the wall surface of the pressure chamber by the capacity detector. Accordingly, the liquid remaining amount can be grasped in advance by the control unit detecting the remaining amount of the liquid inside the liquid container based on the pressure inside the supplying passage detected by the pressure detecting unit, whereby the occurrence of the defective printing caused by the run-out of ink can be prevented.

Moreover, in the inkjet printing device according to the present invention, preferably the pressure detecting unit includes: an intermediate pack that is provided within the supplying passage, and stores therein the liquid from the liquid container; and a capacity detector that detects a displacement of a wall surface of the intermediate pack, the intermediate pack is a bag-shaped member that is formed of a resin material of which wall surface is displaced accompanying a change in a liquid amount stored inside, and the pressure detecting unit detects the pressure within the supplying passage by detecting the displacement of the wall surface of the intermediate pack by the capacity detector.

According to the above configuration, the pressure detecting unit detects the displacement of the wall surface of the intermediate pack by the capacity detector, and detects the pressure within the supplying passage for supplying the liquid to the liquid jetting head based on the detected displaced amount of the wall surface. The intermediate pack provided in the supplying passage is a bag-shaped member that is formed of the resin material, of which wall surface is displaced accompanying the change in the liquid amount stored inside.

That is, the pressure detecting unit detects the pressure inside the supplying passage by detecting the displacement of the wall surface of the intermediate pack by the capacity detector. Accordingly, the liquid remaining amount can be grasped in advance by the control unit detecting the remaining amount of the liquid inside the liquid container based on the pressure inside the supplying passage detected by the pressure detecting unit, whereby the occurrence of the defective printing caused by the run-out of ink can be prevented.

Further, in the inkjet printing device according to the present invention, preferably the liquid supplying unit further includes: a casing having a higher rigidity than the pressure chamber, and a part of the pressure chamber adheres to the inside of the casing.

According to the above configuration, the pressure chamber being the bag-shaped member formed of the flexible resin material is provided within the device by adhering to the inside of the casing with the higher rigidity than the pressure chamber, whereby the liquid supplying unit can be provided at a desired position in a desired direction within the device. Accordingly, by providing the pressure chamber housed in such a casing in a state where its liquid supplying direction is vertically upright along a side wall of the device, space can be saved and a plurality of liquid supplying units can be provided in a limited space.

Further, even in a case where the liquid supplying unit is mounted in a carriage of the liquid jetting head, an influence of a force of inertia generated by a scanning movement of the carriage applied to the liquid within the pressure chamber can be reduced, whereby the occurrence of the cavitation by the scanning movement of the carriage and the pressure fluctuation within the pressure chamber can be reduced.

Moreover, in the inkjet printing device according to the present invention, preferably the pressure chamber is provided therein with a plate-shaped member having a higher rigidity than the resin material.

According to the above configuration, since the pressure chamber can be prevented from being deformed in an unexpected direction, for example, a detection error can be prevented from occurring in the case of detecting the displacement of the wall surface of the pressure chamber. Further, in the case where the liquid supplying unit is mounted in the carriage of the liquid jetting head, the liquid in the pressure chamber can be prevented from suddenly moving even if a force of inertia is generated by the scanning movement of the carriage. Due to this, the occurrence of the cavitation by the scanning movement of the carriage and the pressure fluctuation within the pressure chamber can be reduced.

A liquid supplying device according to the present invention is a liquid supplying device that supplies liquid to a liquid jetting head configured to discharge the liquid onto a medium, and is characteristic in including: a pressure chamber that is connected to a supplying passage connecting a liquid container storing liquid and the liquid jetting head, stores therein the liquid from the liquid container, and supplies the liquid to the liquid jetting head; a valve provided on the supplying passage between the liquid container and the pressure chamber so as to open and close the supplying passage; and a negative pressure generating unit that applies a biasing force in a direction along which a distance between opposing inner walls of the pressure chamber is increased, wherein the pressure chamber is a bag-shaped member that is formed of a resin material of which wall surface is displaced accompanying a change in a liquid amount stored inside.

According to the above configuration, same effects as those of the inkjet printing device according to the present invention can be achieved.

EFFECTS OF THE INVENTION

The present invention causes liquid to be discharged from the liquid jetting head by making the inside of the supplying passage for supplying the liquid to the liquid jetting head be at a negative pressure by the pressure chamber formed of the resin material with the superior gas barrier property, so the occurrence of the cavitation in the liquid jetting head is reduced, and a discharging property of the liquid jetting head can be stabilized.

EMBODIMENTS OF THE INVENTION

Hereinbelow, embodiments of the present invention will be described with reference to FIGS. 1 to 8.

(Inkjet Printing Device 100)

Figure 2:
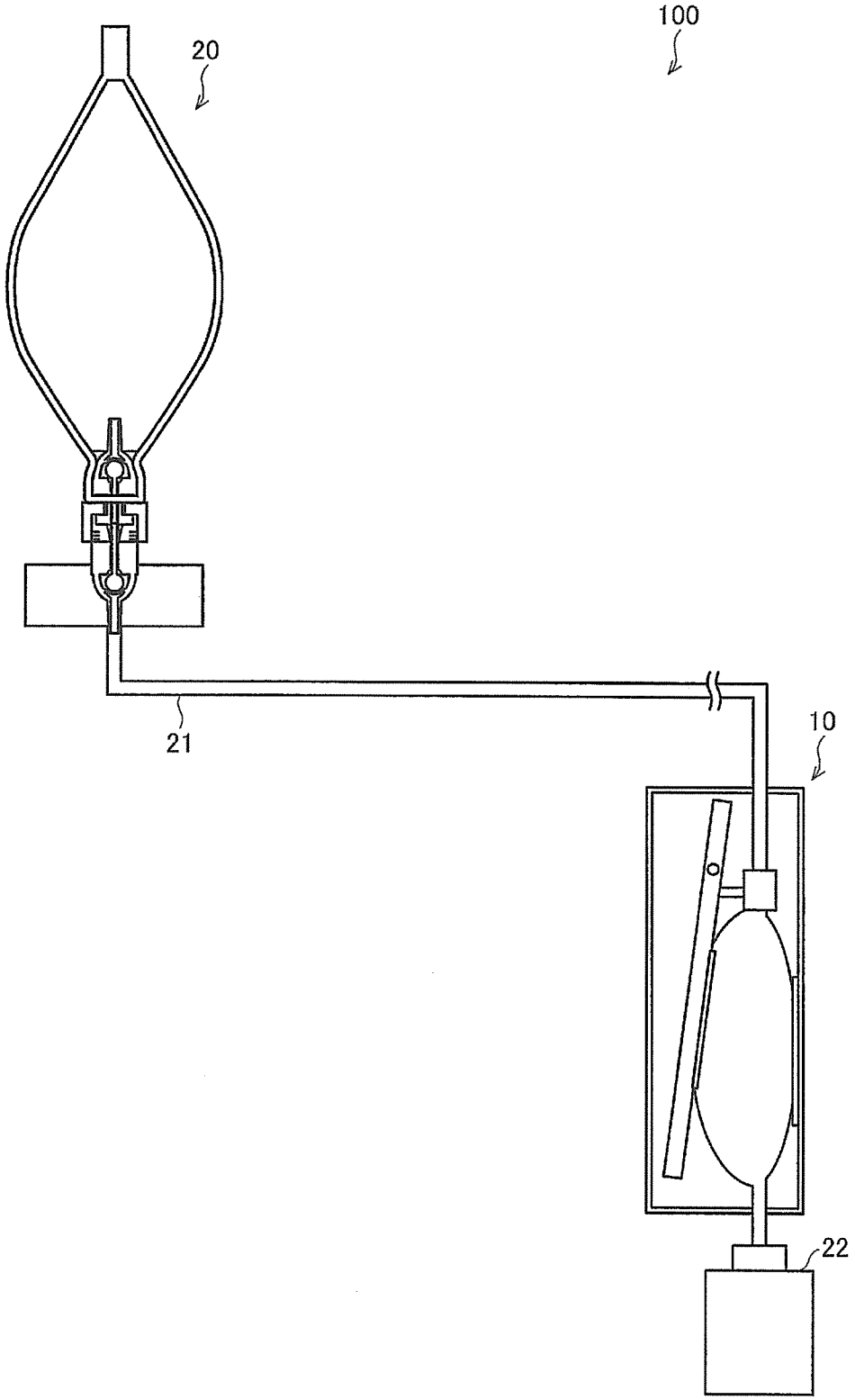
FIG. 2 is a schematic diagram explaining an ink supplying passage in the inkjet printing device according to one embodiment of the present invention.

As shown in FIG. 2, an inkjet printing device 100 includes an ink supplying unit (liquid supplying unit) 10 that supplies ink in a liquid container 20 to an inkjet head (liquid jetting head) 22 that discharges ink (liquid) onto a recording medium (medium). FIG. 2 is a schematic diagram explaining an ink supplying passage in the inkjet printing device according to one embodiment of the present invention. The liquid container 20 and the ink supplying unit 10, as well as the ink supplying unit 10 and the inkjet head 22 are respectively connected by a supplying passage 21. Notably, the ink supplying unit 10 may be provided separately from the inkjet head 22 as shown in FIG. 2, or may be on-carriage by being provided within a carriage of the inkjet head 22.

(Liquid Container 20)

The liquid container 20 is a container for storing the ink to be discharged by the inkjet head 22. The ink in the liquid container 20 is supplied to the ink supplying unit 10 and the inkjet head 22 through the supplying passage 21. The liquid container 20 has a gas barrier property, and the liquid container 20 and the supplying passage 21 are preferably connected by a joint member and the like that can prevent entrance of gas. The liquid container 20 is preferably a container formed of a material having a superior gas barrier property, and for example, it may be a resin-made ink pack and an ink tank, and the like. Further, the liquid container 20 may be a large-capacity container that can be used for an industrial inkjet printing device of which continued operation is expected. Moreover, to prevent a run-out of the ink, a plurality of liquid containers 20 may be provided as spare liquid containers, and when one liquid container 20 runs out of ink, the ink may be supplied to the inkjet head 22 by switching to another liquid container 20.

(Supplying Passage 21)

The supplying passage 21 connects between the liquid container 20 and the inkjet head 22 in the inkjet printing device 100, and configures a passage for supplying the ink to the inkjet head 22 from the liquid container 20. As shown in FIG. 2, in the inkjet printing device 100, the supplying passage 21 causes the liquid container 20 and the ink supplying unit 10 to be communicated, and also causes the ink supplying unit 10 and the inkjet head 22 to be communicated. The supplying passage 21 is a pipe having a cavity therein for letting the ink pass through, and is preferably formed of a material with a superior gas barrier property. Further, it is preferable for the supplying passage 21 to have flexibility from a viewpoint of its easy accommodation in the inkjet printing device 100.

(Ink Supplying Unit 10)

Figure 1:
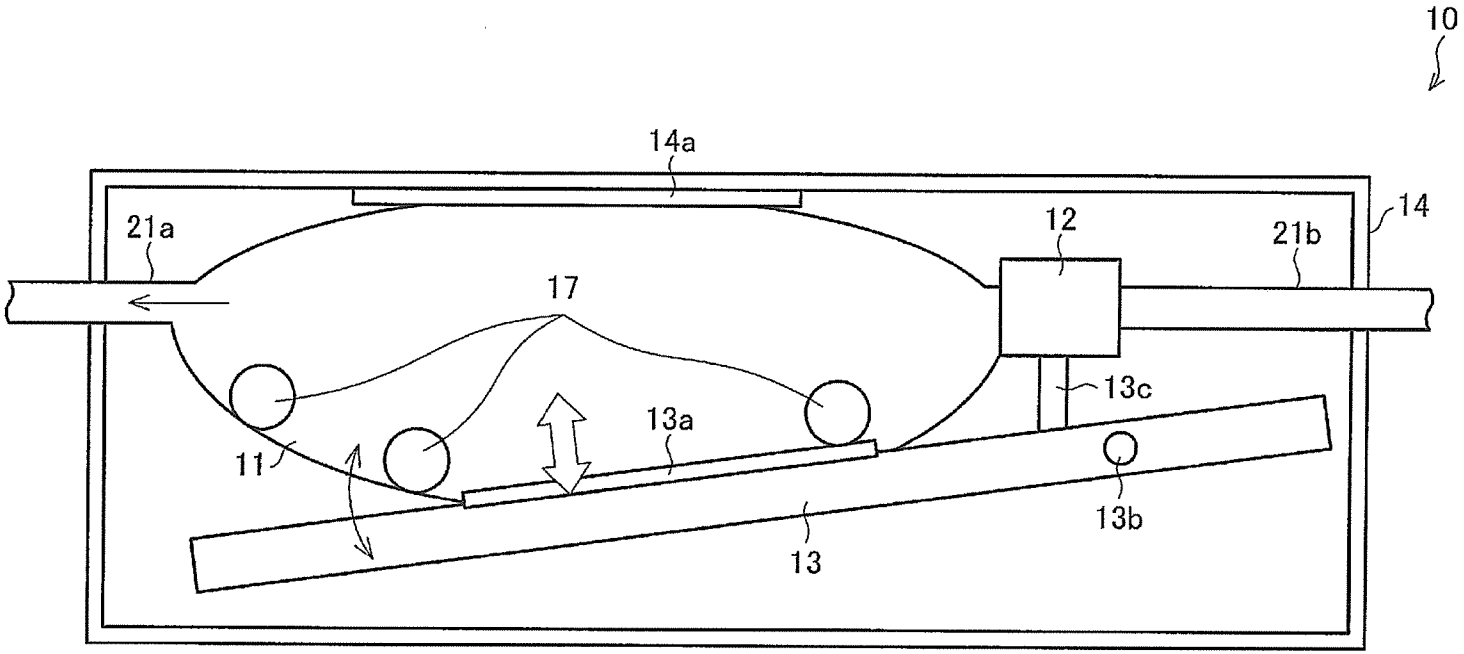
FIG. 1 is a schematic diagram showing an example of an ink supplying unit provided in an inkjet printing device according to one embodiment of the present invention.

As shown in FIG. 1, the ink supplying unit 10 includes a pressure chamber 11, a valve 12, and a negative pressure generating unit 13. FIG. 1 is a schematic diagram showing an example of the ink supplying unit provided in the inkjet printing device according to one embodiment of the present invention. Further, in the ink supplying unit 10, the pressure chamber 11 may be provided in a casing 14. The ink supplying unit 10 adjusts a pressure in the ink supplying passage configured of the liquid container 20, the supplying passage 21, and the inkjet head 22, so as to function as a damper for stably discharging the ink from the inkjet head 22 without causing any defects such as cavitation and the like. Since the ink supplying unit 10 includes a group of members for adjusting the pressure in the ink supplying passage such as the valve 12, it may be termed a valve unit.

<Pressure Chamber 11>

The pressure chamber 11 is connected to the supplying passage 21 that connects the liquid container 20 and the inkjet head 22. In FIG. 1, the supplying passage 21 on an inkjet head 22 side is termed a supplying passage 21*a*, and the supplying passage 21 on a liquid container 20 side is termed a supplying passage 21*b*. The pressure chamber 11 stores the ink supplied from the liquid container 20 to the pressure chamber 11 through the supplying passage 21*b* therein, and supplies the same to the inkjet head 22 through the supplying passage 21*a*.

The pressure chamber 11 is a bag-shaped member formed of a resin material of which wall surface is displaced in accordance with a change in a liquid amount stored therein. That is, the pressure chamber 11 is formed of the resin material having a flexibility by which the wall surface is displaced in accordance with the change in the liquid amount stored therein. This resin material may have a flexibility to become warped by a biasing force applied from the negative pressure generating unit 13, that is, it may be of a resin material that deforms by the pressure chamber 11 being warped when the biasing force is applied from the negative pressure generating unit. The biasing force that the negative pressure generating unit 13 applies to the pressure chamber 11 may for example be a force by which the pressure inside the pressure chamber 11 becomes −0.5 kPa or more and −3.0 kPa or less with respect to atmospheric pressure.

As the resin material fanning the pressure chamber 11, for example, polypropylene, polyethylene, polyethylene terephthalate, nylon, polyamide and the like may be exemplified, and it may have a multilayer structure in which an aluminum foil or an aluminum deposition layer is provided on such a resin material as needed. The pressure chamber 11 may be an ink pack that is formed of such a resin material. Due to being formed of such a resin material, the pressure chamber 11 has a superior gas barrier property, and in addition it can be obtained at a low cost.

The pressure chamber 11 is formed such that a distance between the opposing inner walls is displaced in an approaching direction when the ink amount stored therein is decreased, and the distance between the inner walls is displaced in a separating direction when the ink amount stored therein is increased. That is, in the pressure chamber 11, an ink storing space expands or shrinks according to the ink amount stored therein.

The pressure chamber 11 may house therein a stirring member 17 that stirs the ink stored therein. As the stirring member 17, for example, a spherical member made of resin or metal may be exemplified. A plurality of stirring members 17 may be housed in the pressure chamber 11. By housing such stirring members 17 inside the pressure chamber, for example, in a case of causing the pressure chamber 11 to perform a scan by being installed on a carriage, the stirring members 17 move within the pressure chamber 11 accompanying a scanning movement of the carriage, whereby the ink inside the pressure chamber 11 can be stirred.

The pressure chamber 11 may be provided therein with a plate-shaped member having higher rigidity than the resin material forming the pressure chamber 11. Such a plate-shaped member is not limited as to its size and how it is installed and the like, so long as it does not shut off a flow of the ink from the supplying passage 21*b* to the supplying passage 21*a*. The plate-shaped member may be provided so as to partition the inside of the pressure chamber 11 into a plurality of liquid chambers. Further, a hole may be provided in the plate-shaped member. Due to this, the rigidity of the pressure chamber 11 can be increased without obstructing the flow of the ink.

Accordingly, since the pressure chamber 11 can be prevented from being deformed in an unexpected direction by providing the plate-shaped member with high rigidity inside the pressure chamber 11, for example, a detection error can be prevented from occurring in a case of detecting a displacement of the wall surface of the pressure chamber 11. Even if force of inertia is generated by the scanning movement of the carriage in a case of having installed the ink supplying unit 10 in the carriage of the inkjet head 22, the liquid inside the pressure chamber 11 can be prevented from suddenly moving. Due to this, the generation of cavitation caused by the scanning movement of the carriage and the pressure fluctuation within the pressure chamber 11 can be reduced. Further, by providing the plate-shaped member with high rigidity inside the pressure chamber 11, the pressure chamber 11 is prevented from deforming in an unexpected direction and a motion path of the stirring members 17 is prevented from being closed, whereby the motion path of the stirring members 17 can be ensured.

A connection port to the supplying passage 21*a* on an inkjet head 22 side of the pressure chamber 11 is preferably provided above a liquid surface when the liquid of 5% or more and 50% or less of a capacity of the pressure chamber 11 is stored in the pressure chamber 11. Further, more preferably, the connection port to the supplying passage 21 a on the inkjet head 22 side of the pressure chamber 11 is preferably provided above the liquid surface when the liquid of 15% or more and 40% or less of the capacity of the pressure chamber 11 is stored in the pressure chamber 11, and still more preferably provided above the liquid surface when the liquid of 25% or more and 40% or less of the capacity of the pressure chamber 11 is stored in the pressure chamber 11. Due to this, the connection port to the supplying passage 21*a* on the inkjet head 22 side of the pressure chamber 11 is provided on a higher portion side, so that even larger amount of ink can be stored in the pressure chamber 11. Due to this, for example, the displaced amount can sufficiently be detected in a case of detecting the displaced amount of the wall surface of the pressure chamber 11, whereby detection accuracy can be improved.

The pressure chamber 11 preferably has its longitudinal direction parallel to a gravitational direction. Accordingly, the influence of a force of inertia by a carriage scanning can be reduced by providing the pressure chamber 11 vertically. Further, in the pressure chamber 11, the connection port to the supplying passage 21a on the inkjet head 22 side is preferably provided so as to guide the ink out in a direction vertical to a scanning movement direction of the carriage. Due to this, the pressure fluctuation in the ink to be supplied to the inkjet head 22 caused by the force of inertia generated by the scanning movement of the carriage can be prevented.

<Valve 12>

The valve 12 is provided in the supplying passage 21*b* between the liquid container 20 and the pressure chamber 11, and it adjusts an amount of the ink flowing into the pressure chamber 11 from the liquid container 20 by opening and closing the supplying passage 21*b*.

Figure 3:
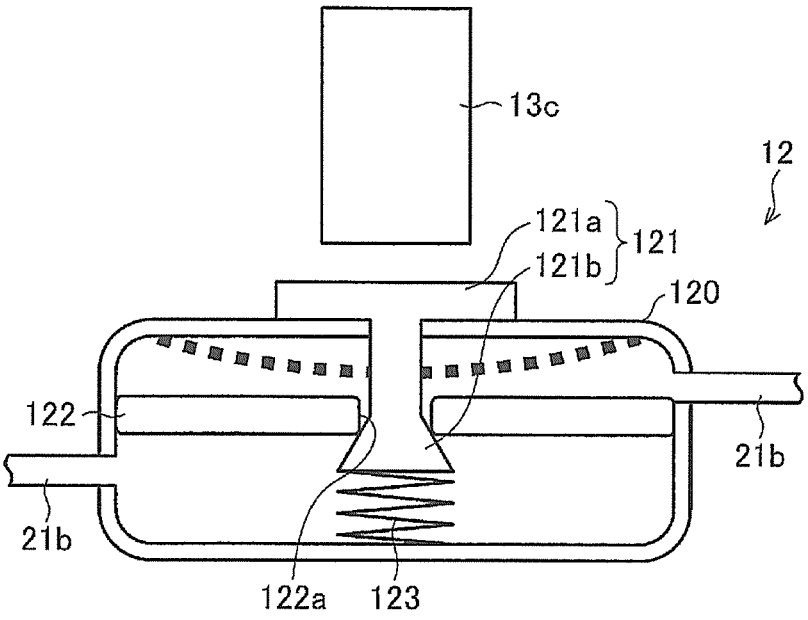
FIG. 3 is a schematic diagram showing an example of a valve provided in the ink supplying unit shown in FIG. 1.

The valve 12 can be configured of a well-known diaphragm valve. As the valve 12, for example, a valve that opens and closes the ink flowing passage by a valve body 121 being displaced according to a pressure difference between inside and outside a liquid chamber 120 as shown in FIG. 3 may be used. FIG. 3 is a schematic diagram showing an example of the valve provided in the ink supplying unit 10 shown in FIG. 1.

As shown in FIG. 3, the valve body 121 is configured of an outer-side portion 121*a* positioned on the outside of the liquid chamber 120, and an inner-side portion 121*b* positioned on the inside of the liquid chamber 120. The inside of the liquid chamber 120 is partitioned into a liquid chamber of a liquid container 20 side and a liquid chamber of a pressure chamber 11 side by a partitioning plate 122 having an inter-liquid chamber passage 122*a*. The inner-side portion 121*b* of the valve body 121 is provided so as to penetrate through the inter-liquid chamber passage 122*a*. Further, the inner-side portion 121*b* of the valve body 121 is connected to a spring 123 connected to an inner wall of the liquid chamber 120 on the pressure chamber 11 side, and is biased by the spring 123 in a direction along which the inter-liquid chamber passage 122*a* is closed.

The valve 12 is configured such that liquid is supplied from the supplying passage 21*b* to the pressure chamber 11 with the inter-liquid chamber passage 122*a* being opened, when the outer-side portion 121*a* is pressed by a contacting portion 13*c* of the negative pressure generating unit 13 to be described later. That is, when the contacting portion 13*c* presses the outer-side portion 121*a*, the outer-side portion 121*a* causes a side wall of the liquid chamber 120 to be displaced inwardly (displaced to a position shown by a dotted line in FIG. 3), the inner-side portion 121*b* moves in a direction along which the biasing force of the spring 123 is canceled, and the inter-liquid chamber passage 122*a* is opened. Due to this, the ink from the supplying passage 21*b* flows from the liquid chamber on the liquid container 20 side into the liquid chamber on the pressure chamber 11 side, and the ink amount inside the pressure chamber 11 is increased.

Since the contacting portion 13*c* presses the outer-side portion 121*a* of the valve 12 when the ink amount inside the pressure chamber 11 becomes less than a predetermined amount, the valve 12 opens only when the ink amount in the pressure chamber 11 becomes less than the predetermined amount, and closes when the ink amount in the pressure chamber 11 is equal to the predetermined amount or more. The predetermined ink amount in the pressure chamber 11 can suitably be set according to a size of the pressure chamber, an ink droplet amount to be discharged from the inkjet head 22, and the like.

<Negative Pressure Generating Unit 13>

The negative pressure generating unit 13 applies a biasing force in the direction along which the distance between opposing inner walls of the pressure chamber 11 is increased. Since the pressure chamber 11 is formed so as to be warped by the biasing force applied from the negative pressure generating unit 13, the negative pressure generating unit 13 applies this biasing force, so that the pressure chamber 11 is warped, whereby the inside of the pressure chamber 11 can be at a negative pressure.

As shown in FIG. 1, the negative pressure generating unit 13 adheres to the pressure chamber 11 in an adhering portion 13*a*, and causes the wall surface of the pressure chamber 11 on an adhering portion 13*a* side to be displaced in a direction separating away from its opposing inner wall, by being displaced by its own weight in a direction of separating away from the pressure chamber 11 with a fixed portion 13*b* as a fulcrum point. In FIG. 1, the negative pressure generating unit 13 is provided on a lower side along the gravitational direction than the pressure chamber 11.

Due to this, the negative pressure generating unit 13 causes the biasing force in the direction along which the distance between the opposing inner walls in the pressure chamber 11 is increased to be generated. By the biasing force applied by the negative pressure generating unit 13, the wall surface of the pressure chamber 11 on the adhering portion 13*a* side is displaced by being warped, and the inside of the pressure chamber 11 comes to be at a negative pressure. Further, with the pressure chamber 11 being at the negative pressure, the inside of the supplying passage 21 connected to the pressure chamber 11 also comes to be at a negative pressure. Accordingly, with the negative pressure inside the pressure chamber 11 and the supplying passage 21 being maintained by the negative pressure generating unit 13, the ink discharge from the inkjet head 22 can be performed in a stable manner.

The fixed portion 13*b* is fixed in the casing 14. The contacting portion 13*c* is attached to the negative pressure generating unit 13. When the ink amount within the pressure chamber 11 is decreased, the ink storage space in the pressure chamber 11 shrinks, and the distance between the opposing inner walls becomes shorter, the negative pressure generating unit 13 is displaced accompanying the displacement of the wall surfaces of the pressure chamber 11, the distance between the contacting portion 13*c* and the valve 12 becomes shorter, and the contacting portion 13*c* makes contact with the valve 12. When the ink amount within the pressure chamber 11 is further decreased, the valve 12 opens the ink flowing passage by being pressed by the contacting portion 13*c*, and the ink flows into the pressure chamber 11. Accordingly, when the ink is sufficiently stored in the pressure chamber 11, the pressure inside the pressure chamber 11 is maintained by the valve 12 being closed, and when the ink within the pressure chamber 11 decreases, the valve 12 is opened and the ink in the pressure chamber 11 is replenished.

<Casing 14>

The casing 14 is for housing the pressure chamber 11. The casing 14 has a structure having a higher rigidity than the pressure chamber 11. As a material configuring the casing 14, metal, resin and the like may be exemplified, however, light-weight and inexpensive resin may suitably be used. Specifically, polypropylene, polyethylene, polyethylene terephthalate and the like may be used.

The casing 14 adheres to a position opposing the adhering portion 13*a* of the pressure chamber in an adhering portion 14*a*. Due to this, the position of the pressure chamber 11 itself is not displaced by the displacement of the negative pressure generating unit 13, but is displaced so that the distance between the inner walls of the pressure chamber 11 increases.

Accordingly, since the pressure chamber 11, which is the bag-shaped member formed of resin material having flexibility, adheres to the inside of the casing 14 with the high rigidity and thereby provided in the inkjet printing device 100, the ink supplying unit 10 can be provided at any desired position in the inkjet printing device 100 in a desired direction. Accordingly, by providing the pressure chamber 11 that is housed in such a casing 14 within the inkjet printing device 100 in a state where its ink supplying direction is vertically upright along a side wall of the device, space can be saved and it is also possible to provide a plurality of ink supplying units 10 within a limited space.

Further, even in a case where the ink supplying unit 10 is mounted in the carriage of the inkjet head 22 by housing the pressure chamber 11 in the casing 14, the influence which the force of inertia generated by the scanning movement of the carriage imposes on the liquid inside the pressure chamber 11 can be reduced. Due to this, the generation of cavitation caused by the scanning movement of the carriage and the pressure fluctuation within the pressure chamber 11 can be reduced.

(Ink Supplying Unit 40)

Figure 4:
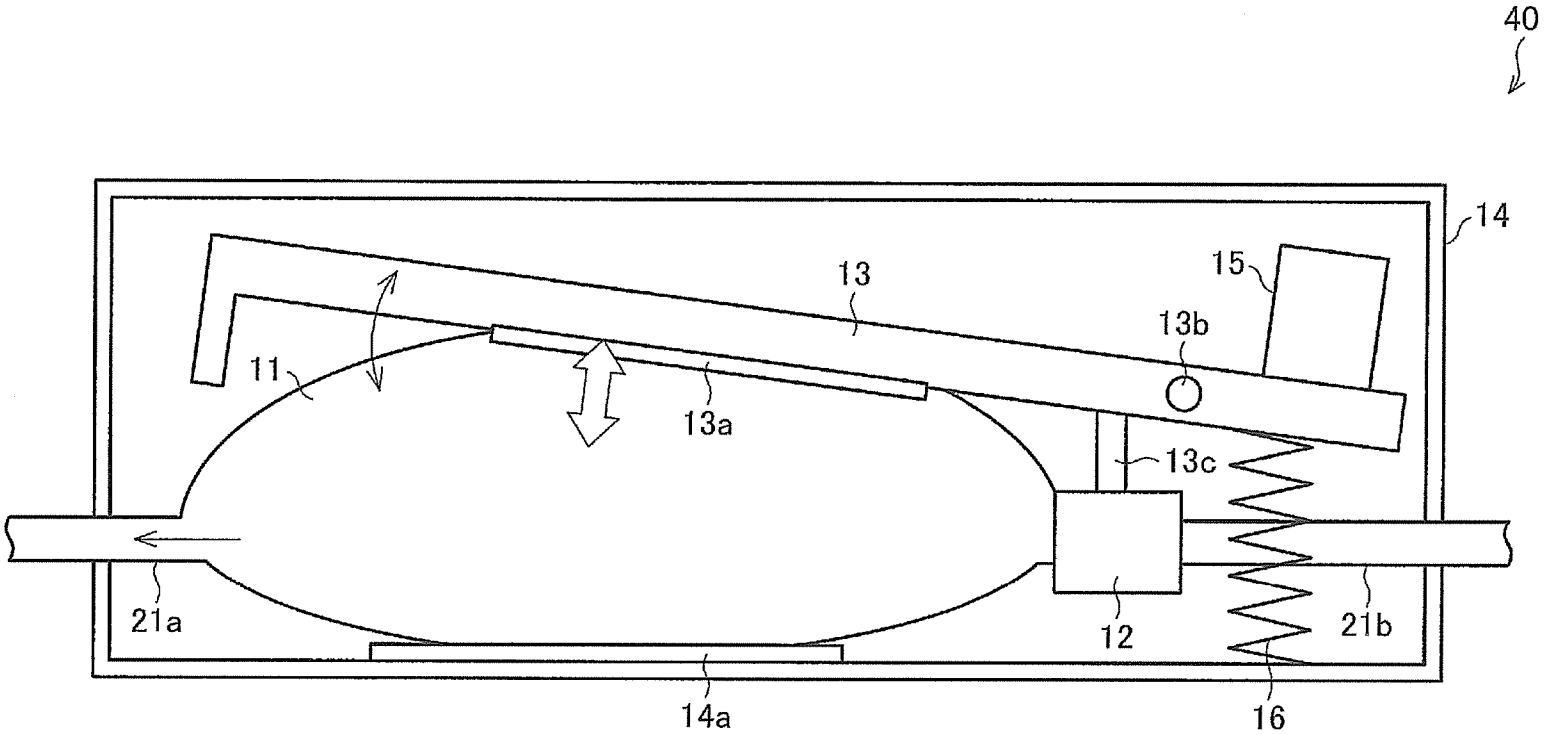
FIG. 4 is a schematic diagram showing another example of an ink supplying unit provided in an inkjet printing device according to one embodiment of the present invention.

As shown in FIG. 4, an ink supplying unit 40 differs from the ink supplying unit 10 shown in FIG. 1 primarily in that a weight 15 and a spring 16 are attached to the negative pressure generating unit 13. FIG. 4 is a schematic diagram showing another example of the ink supplying unit provided in the inkjet printing device according to one embodiment of the present invention. Further, in FIG. 4, components that are same as FIG. 1 are given the same reference numbers. Accordingly, as to the ink supplying unit 40, points differing from the ink supplying unit 10 will be described in detail, and detailed description for other points will be omitted.

In the negative pressure generating unit 13, the weight 15 is provided on a surface that is opposite to a surface on an adhering portion 13*a* side at a position on an opposite side of the adhering portion 13*a* with the fixed portion 13*b* in between. Further, the spring 16 is provided at a position that opposes the weight 15 with the negative pressure generating unit 13 in between. In FIG. 4, the negative pressure generating unit 13 is positioned on an upper side than the pressure chamber 11 in the gravitational direction.

A portion of the negative pressure generating unit 13 on a weight 15 side than the fixed portion 13*b* is displaced in a direction approaching the pressure chamber 11 by a load of the weight 15. Further, a force in the direction approaching the pressure chamber 11 by the load of the weight 15 is transmitted to the adhering portion 13*a* through the fixed portion 13*b* as a force in a direction separating away from the pressure chamber 11, and becomes a biasing force in a direction along which the distance between the inner walls of the pressure chamber 11 is increased. To adjust the force in the direction approaching the pressure chamber 11 by the weight 15, the spring 16 applies the force in the direction separating away from the pressure chamber 11 to the negative pressure generating unit 13 on the weight 15 side than the fixed portion 13*b*.

As shown in FIG. 4, the negative pressure generating unit 13 may have an end portion on an opposite side from where the weight 15 is provided to be protruded toward the pressure chamber 11 side. Due to this, when the displaced amount of the wall surface of the pressure chamber 11 is detected, the displaced amount can sufficiently be detected even in a case where the displaced amount of the wall surface of the pressure chamber 11 is small.

Accordingly, with the ink supplying unit 40, the negative pressure generating unit 13 can be provided on the upper side in the gravitational direction than the pressure chamber 11 by providing the weight 15 and the spring 16 on the negative pressure generating unit 13.

(Ink Supplying Unit 50)

Figure 5:
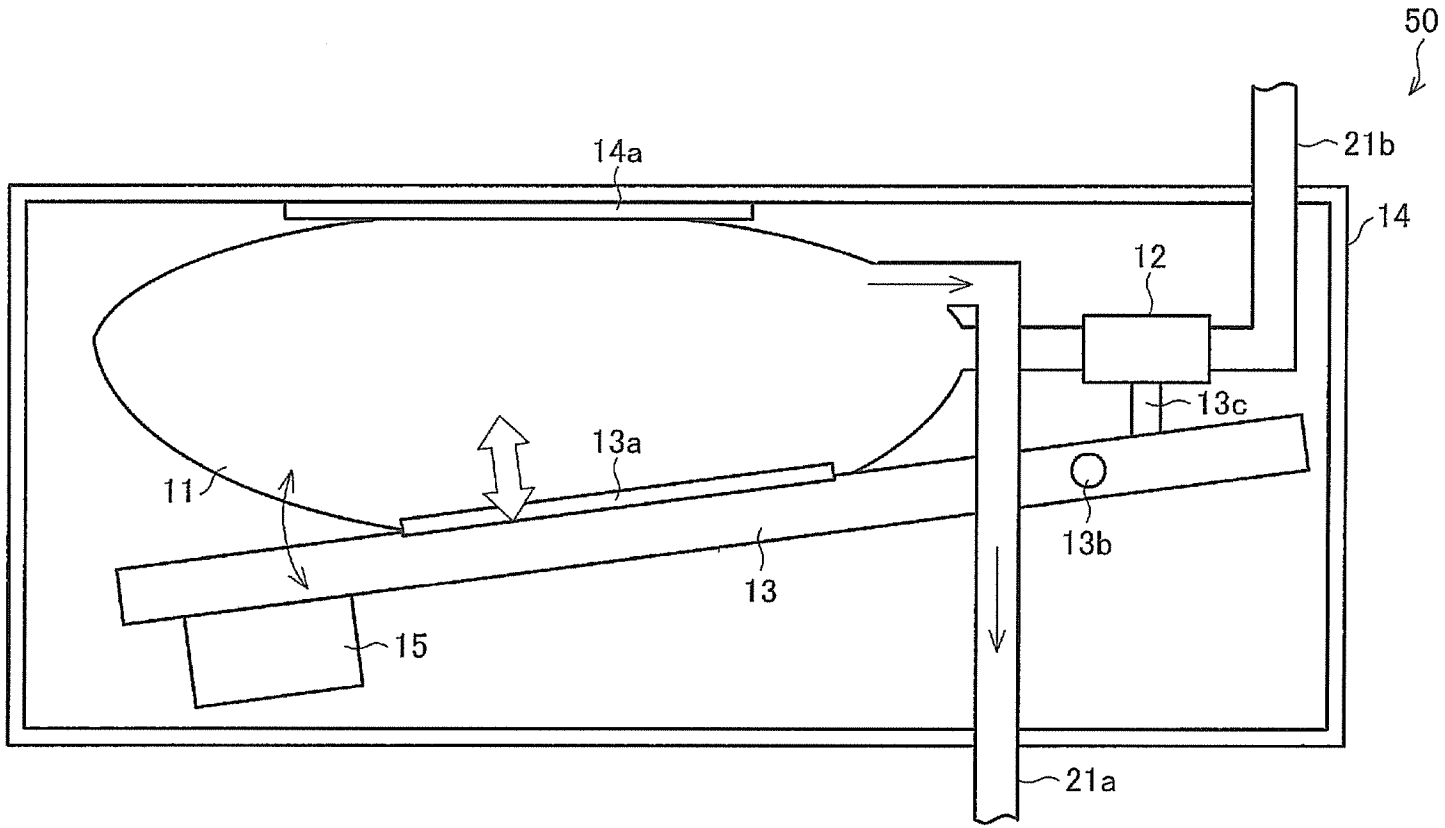
FIG. 5 is a schematic diagram showing another example of an ink supplying unit provided in an inkjet printing device according to one embodiment of the present invention.

As shown in FIG. 5, an ink supplying unit 50 differs from the ink supplying unit 10 shown in FIG. 1 primarily in a configuration of the negative pressure generating unit 13 and a positional relationship of the supplying passage 21 and the pressure chamber 11. FIG. 5 is a schematic diagram showing another example of the ink supplying unit provided in the inkjet printing device according to one embodiment of the present invention. Further, in FIG. 5, components that are same as FIG. 1 are given the same reference numbers. Accordingly, as to the ink supplying unit 50, points differing from the ink supplying unit 10 will be described in detail, and detailed description for other points will be omitted.

In FIG. 5, the negative pressure generating unit 13 is provided on a lower side in the gravitational direction than the pressure chamber 11. Further, the weight 15 is provided on a surface that is opposite to a surface on an adhering portion 13*a* side at a position on an opposite side of the fixed portion 13*b* with the adhering portion 13*a* in between. A portion of the negative pressure generating unit 13 closer to the weight 15 than the fixed portion 13*b* is displaced in the direction separating away from the pressure chamber 11 by the load of the weight 15. This force in the direction separating away from the pressure chamber 11 by the load of the weight 15 is transmitted to the adhering portion 13*a* as a force in a direction separating away from the pressure chamber 11, and becomes a biasing force in a direction along which the distance between the inner walls of the pressure chamber 11 is increased.

Further, in FIG. 5, the connection port between the supplying passage 21*a* on the inkjet head 22 side and the pressure chamber 11 may be provided on a same side as the connection port between the supplying passage 21*b* on the liquid container 20 side and the pressure chamber 11. That is, the supplying passage 21*a* and the supplying passage 21*b* do not have to be provided with the pressure chamber 11 in between as shown in FIG. 1. The connection port of the supplying passage 21*a* and the connection port of the supplying passage 21*b* may be provided on the same side of the pressure chamber 11, the supplying passage 21*a* may be bent in a direction of the inkjet head 22, and the supplying passage 21*b* may be bent in a direction of the liquid container 20.

Accordingly, with the ink supplying unit 50, the weight 15 may be provided on the negative pressure generating unit 13 provided on the lower side in the gravitational direction than the pressure chamber 11, and may be provided on a same side as the connection port between the supplying passage 21*b* on the liquid container 20 side and the pressure chamber 11.

(Ink Supplying Unit 60)

Figure 6:
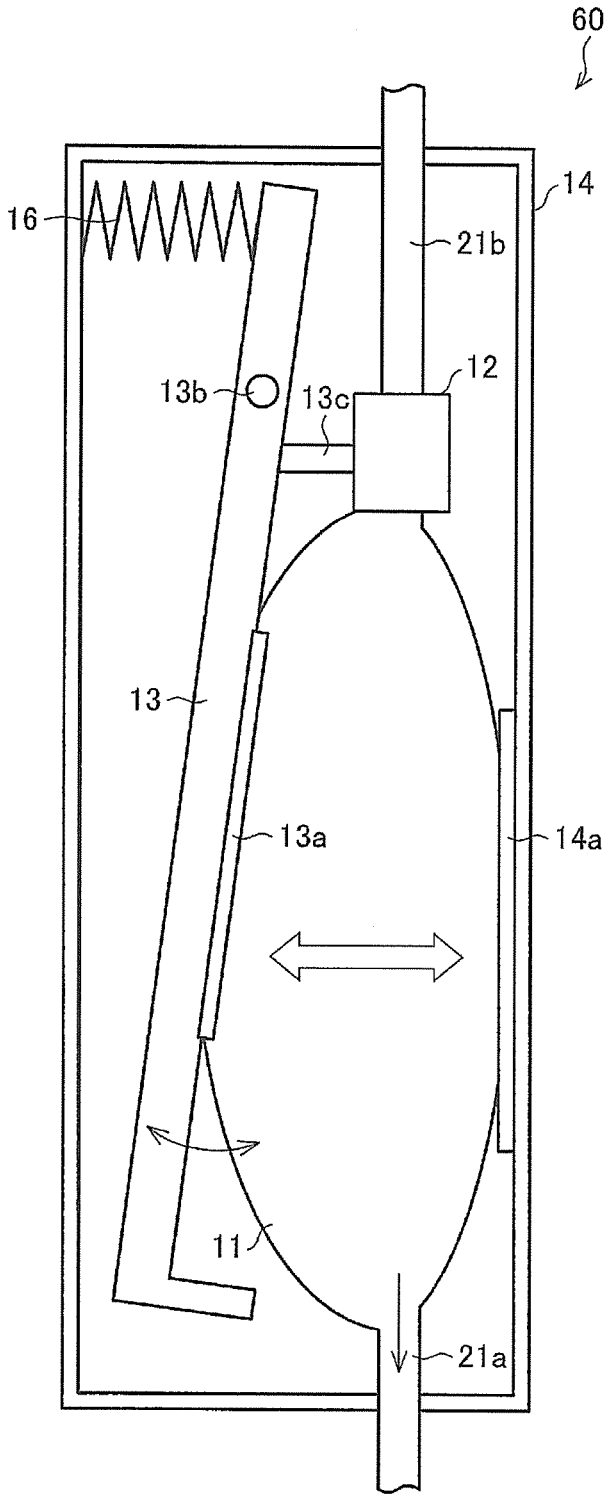
FIG. 6 is a schematic diagram showing another example of an ink supplying unit provided in an inkjet printing device according to one embodiment of the present invention.

As shown in FIG. 6, an ink supplying unit 60 differs from the ink supplying unit 10 shown in FIG. 1 primarily in a configuration of the negative pressure generating unit 13. FIG. 6 is a schematic diagram showing another example of the ink supplying unit provided in the inkjet printing device according to one embodiment of the present invention. Further, in FIG. 6, components that are same as FIG. 1 are given the same reference numbers. Accordingly, as to the ink supplying unit 60, points differing from the ink supplying unit 10 will be described in detail, and detailed description for other points will be omitted.

In FIG. 6, in the ink supplying unit 60, an extending direction of the supplying passage 21 is provided parallel to the gravitational direction. That is, a longitudinal direction of the pressure chamber 11 is provided parallel to the gravitational direction. In the negative pressure generating unit 13, the spring 16 is provided on a surface that is opposite to a surface on the adhering portion 13*a* side at a position on an opposite side of the adhering portion 13*a* with the fixed portion 13*b* in between. The spring 16 causes a portion of the negative pressure generating unit 13 on the spring 16 side to be displaced toward the pressure chamber 11 side. Then, a force in a direction approaching the pressure chamber 11 by the spring 16 is transmitted to the adhering portion 13*a* through the fixed portion 13*b* as a force in a direction separating away from the pressure chamber 11, and becomes a biasing force in a direction along which a distance between inner walls of the pressure chamber 11 is increased.

Accordingly, with the ink supplying unit 60, the pressure chamber 11 can suitably be maintained at a negative pressure, even if the longitudinal direction of the pressure chamber 11 is arranged in a vertical direction.

(Ink Supplying Unit 70)

Figure 7:
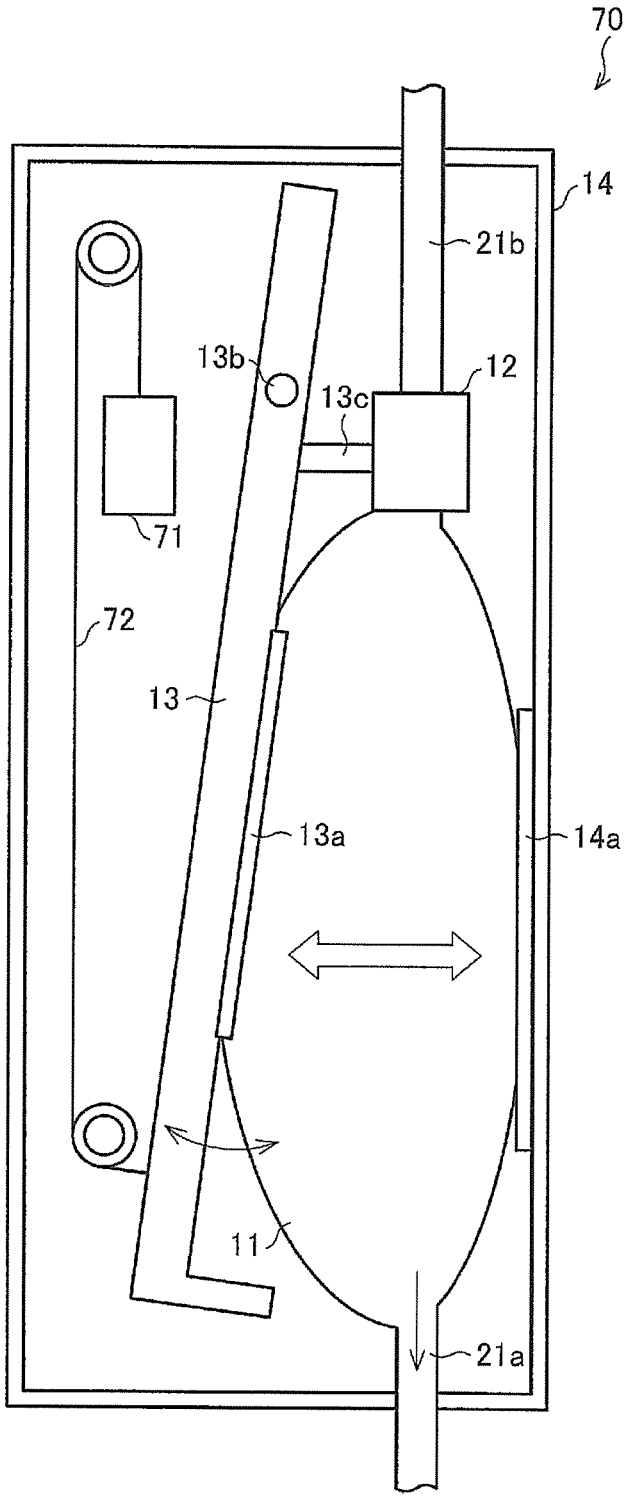
FIG. 7 is a schematic diagram showing another example of an ink supplying unit provided in an inkjet printing device according to one embodiment of the present invention.

As shown in FIG. 7, an ink supplying unit 70 differs from the ink supplying unit 10 shown in FIG. 1 primarily in a configuration of the negative pressure generating unit 13. FIG. 7 is a schematic diagram showing another example of the ink supplying unit provided in the inkjet printing device according to one embodiment of the present invention. Further, in FIG. 7, components that are same as FIG. 1 are given the same reference numbers. Accordingly, as to the ink supplying unit 70, points differing from the ink supplying unit 10 will be described in detail, and detailed description for other points will be omitted.

In FIG. 7, in the ink supplying unit 70, an extending direction of the supplying passage 21 is provided parallel to the gravitational direction. That is, a longitudinal direction of the pressure chamber 11 is provided parallel to the gravitational direction. In the negative pressure generating unit 13, a joint unit 72 for joining a weight 71 is attached to a surface that is opposite to a surface on an adhering portion 13*a* side at a position on an opposite side of the adhering portion 13*a* with the fixed portion 13*b* in between. The joint unit 72 is for example configured of a rope attached to the weight 71 and pulleys, and causes the negative pressure generating unit 13 to be displaced in the direction separating away from the pressure chamber 11 by a load of the weight 71. Due to this, it causes a biasing force in the direction along which the distance between the inner walls of the pressure chamber 11 is increased is generated in the negative pressure generating unit 13.

Accordingly, with the ink supplying unit 70, the inside of the pressure chamber 11 can suitably be maintained at a negative pressure, even if the longitudinal direction of the pressure chamber 11 is arranged in the vertical direction.

(Inkjet Printing Device 200)

Figure 8:
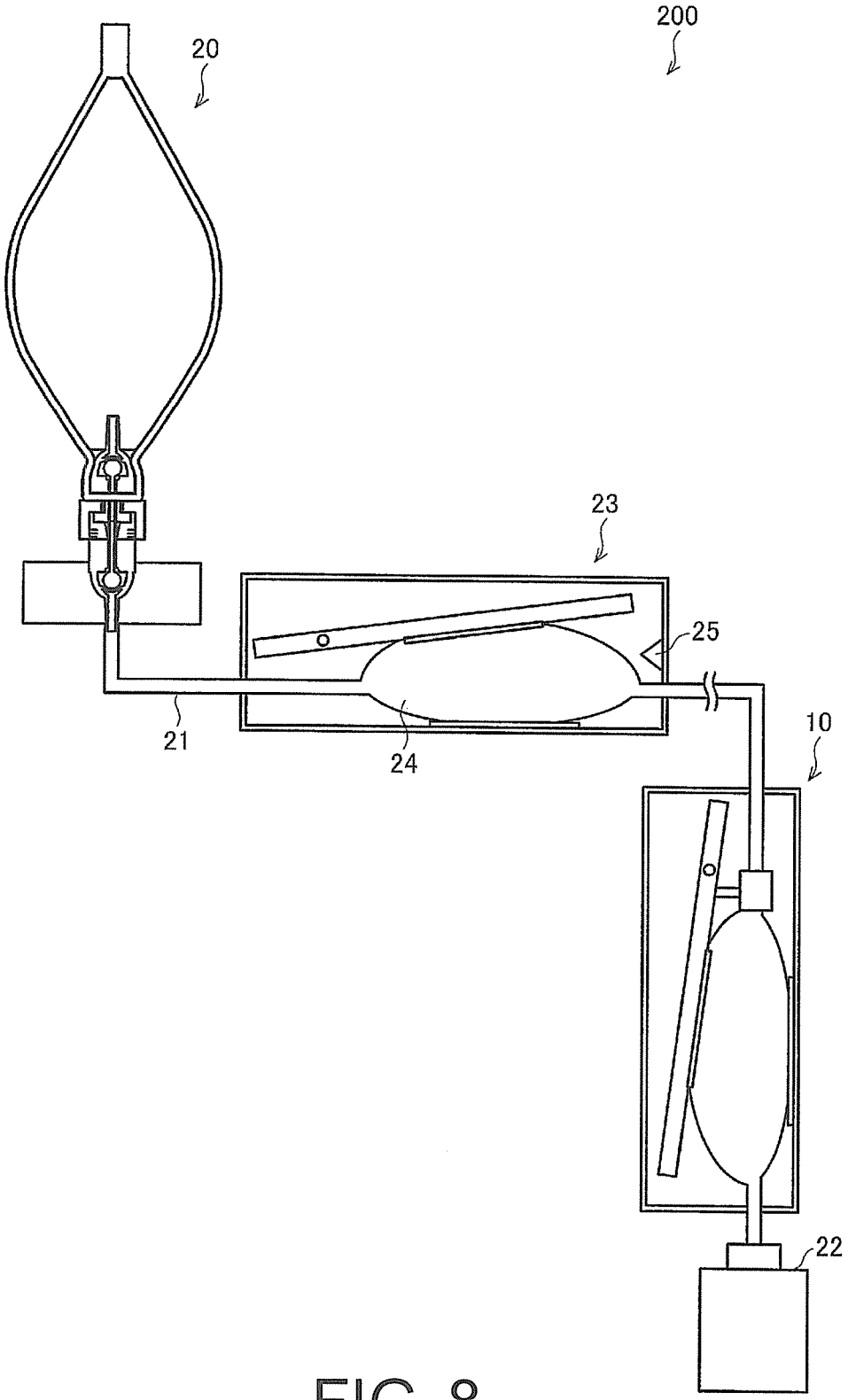
FIG. 8 is a schematic diagram explaining an ink supplying passage in the inkjet printing device according to another embodiment of the present invention.

As shown in FIG. 8, an inkjet printing device 200 is provided with the ink supplying unit 10 that supplies the ink inside the liquid container 20 to the inkjet head 22 for discharging the ink onto a recording medium, and a pressure detector (pressure detecting unit) 23. FIG. 8 is a schematic diagram explaining an ink supplying passage in an inkjet printing device of another embodiment of the present invention. Further, the inkjet printing device 200 is provided with a control unit (not shown). The inkjet printing device 200 differs from the inkjet printing device 100 shown in FIG. 2 in being provided with the pressure detector 23 and a control unit. Accordingly, as to the inkjet printing device 200, points differing from the inkjet printing device 100 will be described in detail, and detailed description for other points will be omitted.

(Pressure Detector 23)

The pressure detector 23 detects a pressure in the supplying passage 21. The pressure detector 23 simply needs to be provided within the supplying passage 21, and as shown in FIG. 8, it may be provided between the liquid container 20 and the ink supplying unit 10, or may be provided between the ink supplying unit 10 and the inkjet head 22. The pressure detector 23 is provided with an intermediate pack 24 and a capacity detector 25, and the pressure within the supplying passage 21 may be detected based on a displaced amount of a wall surface of the intermediate pack 24 detected by the capacity detector 25.

<Intermediate Pack 24>

The intermediate pack 24 is provided within the supplying passage 21, and stores therein the liquid from the liquid container 20. The intermediate pack 24 is a bag-shaped member formed of a resin material, of which wall surface is displaced in accordance with a change in a liquid amount stored therein. The intermediate pack 24 can be configured similarly to the pressure chamber 11. The intermediate pack 24 may be stored in a casing with higher rigidity than the intermediate pack 24.

Similarly to the pressure chamber 11, the intermediate pack 24 has its inside maintained at a negative pressure, and it is formed such that when the stored ink amount is decreased, it is displaced in a direction along which a distance between opposing inner walls decreases; and when the stored ink amount therein is increased, it is displaced in a direction along which the distance between the opposing inner walls increases.

Figure 9:
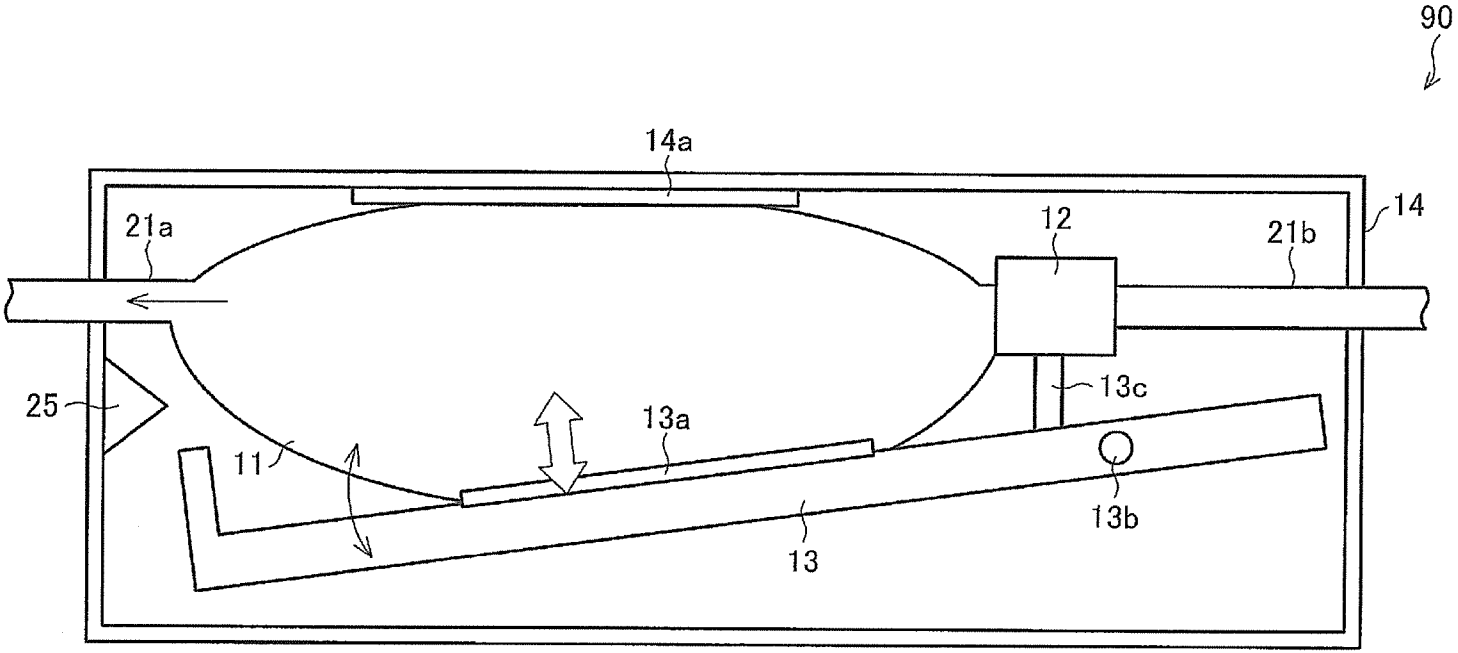
FIG. 9 is a schematic diagram showing another example of an ink supplying unit provided in an inkjet printing device according to one embodiment of the present invention.

Accordingly, the ink supplying unit 10 and the pressure detector 23 as shown in FIG.8 may be formed integrally by replacing the intermediate pack 24 by the pressure chamber 11 and making the pressure chamber 11 function as the intermediate pack 24. That is, as shown in FIG. 9, the ink amount within the pressure chamber 11 is detected by providing a capacity detector 25 to be described later in the ink supplying unit 90 and making the capacity detector 25 detect the displacement of the wall surface of the pressure chamber 11. Further, the pressure detector 23 detects the pressure within the supplying passage 21 based on the displaced amount of the wall surface of the pressure chamber 11. As shown in FIG. 9, the capacity detector 25 is provided on the wall surface of the ink supplying unit 90, and it simply needs to be provided such that the negative pressure generating unit 13 makes contact with the capacity detector 25 by the pressure chamber 11 shrinking when the ink amount within the pressure chamber 11 becomes less than a predetermined amount.

<Capacity Detector 25>

The capacity detector 25 detects the displacement of the wall surface of the intermediate pack 24. The capacity detector 25 is provided within a casing in which the intermediate pack 24 is housed, and it detects the intermediate pack 24 expanding or shrinking its ink storage space in accordance with an amount of ink stored therein. The capacity detector 25 may for example be provided such that the negative pressure generating unit of the intermediate pack 24 makes contact with the capacity detector 25 by the intermediate pack 24 shrinking when the ink amount within the intermediate pack 24 becomes less than a predetermined amount.

Accordingly, the capacity detector 25 detects the displaced amount of the wall surface of the intermediate pack. The displaced amount of the wall surface of the intermediate pack 24 and the pressure within the supplying passage 21 are in a correlated relationship, so that the pressure detector 23 detects the pressure within the supplying passage 21 based on the displaced amount of the wall surface of the intermediate pack 24 detected by the capacity detector 25.

(Control Unit)

The control unit determines that the liquid amount within the liquid container 20 has become less than a predetermined amount when the pressure within the supplying passage 21 detected by the pressure detector 23 becomes less than the predetermined pressure. The control unit can be configured of a known calculating device such as a computer.

When the pressure within the supplying passage 21 detected by the pressure detector 23 becomes less than the predetermined pressure, this means that the ink amount within the intermediate pack 24 is less than a predetermined ink amount, and it is in a state where no liquid is supplied from the liquid container 20 to the intermediate pack 24, that is, in a state in which the liquid container 20 is out of ink. An occurrence of a defective printing caused by unexpected run-out of ink can be prevented by the control unit detecting such an ink run-out.

Accordingly, when the control unit determines that the remaining amount of liquid within the liquid container 20 has become less than the predetermined amount, switching may be performed so that the liquid may be supplied to the inkjet head 22 from a spare liquid container, or replacement of the liquid container 20 may be notified to a user so that the occurrence of a defective printing caused by the run-out of ink can be prevented, even during a time-consuming and continuous printing.

(Liquid Supplying Device)

A liquid supplying device according to the present invention is a liquid supplying device that supplies liquid to a liquid jetting head configured to discharge the liquid onto a medium, and is characteristic in including: a pressure chamber that is connected to a supplying passage connecting a liquid container storing liquid and the liquid jetting head, stores therein the liquid from the liquid container, and supplies the liquid to the liquid jetting head; a valve provided on the supplying passage between the liquid container and the pressure chamber so as to open and close the supplying passage; and a negative pressure generating unit that applies a biasing force in a direction along which a distance between opposing inner walls of the pressure chamber is increased, wherein the pressure chamber is a bag-shaped member that is formed of a resin material of which wall surface is displaced accompanying a change in a liquid amount stored inside.

That is, one embodiment of the liquid supplying device according to the present invention is the ink supplying unit 10 of the inkjet printing device 100 as aforementioned. Accordingly, one embodiment of the liquid supplying device according to the present invention is compliant with the description of the inkjet printing device according to the present invention as aforementioned.

(Supplemental Information)

The inkjet printing device 100 includes the ink supplying unit 10 that supplies ink to the inkjet head 22 configured to discharge the ink onto a recording medium, wherein the ink supplying unit 10 includes: the pressure chamber 11 that is connected to the supplying passage 21 connecting the liquid container 20 storing the ink and the inkjet head 22, stores therein the ink from the liquid container 20, and supplies the ink to the inkjet head 22; the valve 12 provided on the supplying passage 21 between the liquid container 20 and the pressure chamber 11 so as to open and close the supplying passage 21; and the negative pressure generating unit 13 that applies a biasing force in the direction along which the distance between the opposing inner walls of the pressure chamber 11 is increased, and the pressure chamber 11 is a bag-shaped member that is formed of the resin material of which wall surface is displaced accompanying the change in a liquid amount stored inside.

According to the above configuration, the ink supplying unit 10 supplies the ink in the liquid container 20 to the inkjet head 22. The liquid container 20 and the inkjet head 22 are connected through the supplying passage 21. The supplying passage 21 is connected to the pressure chamber 11 for storing therein the ink, and the valve 12 provided between the liquid container 20 and the pressure chamber opens and closes the supplying passage 21 so that the ink inside the liquid container 20 is supplied to the pressure chamber 11.

The pressure chamber 11 is applied with the biasing force in the direction along which the distance between opposing inner walls is increased by the negative pressure generating unit 13. The pressure chamber 11 is a bag-shaped member that is formed of a resin material, of which wall surface is displaced accompanying the change in the liquid amount stored inside. Further, the pressure chamber 11 is warped so that the distance between the inner walls increases by the biasing force applied by the negative pressure generating unit 13. Due to this, the inside of the pressure chamber 11 comes to be at a negative pressure, and the inside of the supplying passage 21 connected to the pressure chamber 11 also comes to be at a negative pressure. Accordingly, the ink is jetted out from the inkjet head 22 by making the inside of the supplying passage for supplying the ink to the inkjet head 22 be at a negative pressure by the ink supplying unit 10.

The resin material that forms the pressure chamber 11 has a superior gas barrier property; thus, according to the inkjet printing device 100, the occurrence of the cavitation in the inkjet head 22 can be reduced to stabilize a jetting performance of the inkjet head 22. Further, since the resin material that forms the pressure chamber 11 is inexpensive, a low-cost inkjet printing device 100 can be provided.

The inkjet printing device 200 further includes the pressure detector 23 that detects a pressure within the supplying passage 21; and the control unit that determines that the ink amount inside the liquid container 20 is less than the predetermined amount when the pressure within the supplying passage 21 detected by the pressure detector 23 becomes less than a predetermined pressure.

According to the above configuration, the pressure in the supplying passage for supplying the ink to the inkjet head 22 is detected by the pressure detector 23. Then, the control unit detects the ink amount inside the liquid container 20 based on the pressure detected by the pressure detector 23. That is, the control unit determines that the remaining amount of the ink inside the liquid container 20 has become less than the predetermined amount when the pressure detected by the pressure detector 23 becomes less than the predetermined pressure.

Accordingly, the remaining amount of the ink inside the liquid container 20 can be detected by detecting the pressure in the ink supplying passage. Accordingly, when the control unit determines that the remaining amount of ink within the liquid container 20 has become less than the predetermined amount, switching may be performed so that the ink may be supplied to the inkjet head 22 from a spare liquid container, or replacement of the liquid container 20 may be notified to a user so that the occurrence of a defective printing caused by the run-out of ink can be prevented, even during a time-consuming and continuous printing.

Further, in the inkjet printing device 200, the pressure detector 23 includes the capacity detector 25 that detects the displacement of the wall surface of the pressure chamber 11, and detects the pressure within the supplying passage 21 by detecting the displacement of the wall surface of the pressure chamber 11 detected by the capacity detector 25.

According to the above configuration, the pressure detector 23 detects the pressure inside the supplying passage 21 by detecting the displacement of the wall surface of the pressure chamber 11 by the capacity detector 25. Accordingly, the liquid remaining amount can be grasped in advance by the control unit detecting the remaining amount of the liquid inside the liquid container 20 based on the pressure inside the supplying passage 21 detected by the pressure detector 23, whereby the occurrence of the defective printing caused by the run-out of ink can be prevented.

Moreover, in the inkjet printing device 200, the pressure detector 23 includes: the intermediate pack 24 that is provided within the supplying passage 21, and stores therein the ink from the liquid container 20; and the capacity detector 25 that detects the displaced amount of the wall surface of the intermediate pack 24, the intermediate pack 24 is a bag-shaped member that is formed of the resin material, of which wall surface is displaced accompanying the change in the ink amount stored inside, and the pressure detector 23 detects the pressure within the supplying passage 21 by detecting the displacement of the wall surface of the intermediate pack 24 by the capacity detector 25.

According to the above configuration, the pressure detector 23 detects the displaced amount of the wall surface of the intermediate pack 24 by the capacity detector 25, and detects the pressure within the supplying passage for supplying the ink to the inkjet head 22 based on the detected displaced amount of the wall surface. The intermediate pack 24 provided in the supplying passage 21 is a bag-shaped member that is formed of the resin material, of which wall surface is displaced accompanying the change in the ink amount stored inside.

That is, the pressure detector 23 detects the pressure inside the supplying passage 21 by detecting the displacement of the wall surface of the intermediate pack 24 by the capacity detector 25. Accordingly, the ink remaining amount can be grasped in advance by the control unit detecting the remaining amount of the ink inside the liquid container 20 based on the pressure inside the supplying passage 21 detected by the pressure detector 23, whereby the occurrence of the defective printing caused by the run-out of ink can be prevented.

Further, in the inkjet printing device 100, the ink supplying unit 10 further includes the casing 14 having the higher rigidity than the pressure chamber 11, and a part of the pressure chamber 11 adheres to the inside of the casing 14.

According to the above configuration, the pressure chamber 11 being the bag-shaped member formed of the flexible resin material is provided within the device by adhering to the inside of the casing 14 with the higher rigidity than the pressure chamber 11, whereby the liquid supplying unit 10 can be provided at a desired position in a desired direction within the device. Accordingly, by providing the pressure chamber 11 housed in such a casing 14 in a state where its ink supplying direction is vertically upright along a side surface of the device, space can be saved and a plurality of liquid supplying units 10 can be provided in a limited space.

Further, even in a case where the ink supplying unit 10 is mounted in the carriage of the inkjet head 22, the influence of the force of inertia generated by the scanning movement of the carriage applied to the ink within the pressure chamber 11 can be reduced, whereby the occurrence of the cavitation by the scanning movement of the carriage and the pressure fluctuation within the pressure chamber 11 can be reduced.

Moreover, in the inkjet printing device 100, the pressure chamber 11 is provided therein with a plate-shaped member having a higher rigidity than the resin material.

According to the above configuration, since the pressure chamber 11 can be prevented from being deformed in an unexpected direction, thus for example, a detection error can be prevented from occurring in the case of detecting the displacement of the wall surface of the pressure chamber 11. Further, even if force of inertia is generated by the scanning movement of the carriage in a case of having installed the ink supplying unit 10 in the carriage of the inkjet head 22, the ink inside the pressure chamber 11 can be prevented from suddenly moving. Due to this, the generation of cavitation caused by the scanning movement of the carriage and the pressure fluctuation within the pressure chamber 11 can be reduced.

The ink supplying unit 10 is a liquid supplying unit that supplies ink to the inkjet head 22 configured to discharge the ink onto a recording medium, and is characteristic in including: the pressure chamber 11 that is connected to the supplying passage 21 connecting the liquid container 20 storing the ink and the inkjet head 22, stores therein the ink from the liquid container 20, and supplies the ink to the inkjet head 22; the valve 12 provided on the supplying passage 21 between the liquid container 20 and the pressure chamber 11 so as to open and close the supplying passage 21; and the negative pressure generating unit 13 that applies the biasing force in the direction along which the distance between the opposing inner walls of the pressure chamber 11 is increased, and the pressure chamber 11 is a bag-shaped member that is formed of a resin material, of which wall surface is displaced accompanying the change in a liquid amount stored inside.

According to the above configuration, same effects as those of the inkjet printing device 100 can be achieved.

The present invention is not limited to the respective embodiments as described above, and various modifications can be made within the scope indicated in the claims; and embodiments obtained by suitably combining technical means respectively disclosed in different embodiments are also included within the technical scope of the present invention.

INDUSTRIAL APPLICABILITY

The present invention can be utilized in a liquid supplying device for an inkjet recording device.

The invention claimed is:

1. An inkjet printing device, comprising:

a liquid supplying unit that supplies liquid to a liquid jetting head configured to discharge the liquid onto a medium, wherein the liquid supplying unit comprises:

a pressure chamber that is connected to a supplying passage connecting a liquid container storing liquid and the liquid jetting head, stores therein the liquid from the liquid container, and supplies the liquid to the liquid jetting head;

a valve provided on the supplying passage between the liquid container and the pressure chamber so as to open and close the supplying passage; and a negative pressure generating unit that applies a biasing force in a direction along which a distance between opposing inner walls of the pressure chamber is increased, and the pressure chamber is a bag-shaped member that is fodeletelined of a resin material of which wall surface is displaced accompanying a change in a liquid amount stored inside, wherein the pressure chamber is mounted in a carriage of the liquid jetting head, and a longitudinal direction of the pressure chamber is parallel to a gravitational direction.

2. The inkjet printing device according to claim 1, further comprising:

a pressure detecting unit that detects a pressure within the supplying passage; and a control unit that determines that a liquid amount inside the liquid container is less than a predetermined amount when the pressure within the supplying passage detected by the pressure detecting unit becomes less than a predetermined pressure.

3. The inkjet printing device according to claim 2, wherein the pressure detecting unit comprises:

a capacity detector that detects a displacement of the wall surface of the pressure chamber, and the pressure within the supplying passage is detected by detecting the displacement of the wall surface of the pressure chamber detected by the capacity detector.

4. The inkjet printing device according to claim 2, wherein the pressure detecting unit comprises:

an intermediate pack that is provided within the supplying passage, and stores therein the liquid from the liquid container; and a capacity detector that detects a displacement of a wall surface of the intermediate pack, the intermediate pack is a bag-shaped member that is formed of a resin material, of which wall surface is displaced accompanying a change in a liquid amount stored inside, and the pressure detecting unit detects the pressure within the supplying passage by detecting the displacement of the wall surface of the intermediate pack by the capacity detector.

5. The inkjet printing device according to claim 1, wherein the liquid supplying unit further comprises: a casing having a higher rigidity than the pressure chamber, and a part of the pressure chamber adheres to the inside of the casing.

6. The inkjet printing device according to claim 1, wherein the pressure chamber is provided therein with a plate-shaped member having a higher rigidity than the resin material.

7. A liquid supplying device that supplies liquid to a liquid jetting head configured to discharge the liquid onto a medium, the liquid supplying device comprising:

a pressure chamber that is connected to a supplying passage connecting a liquid container storing liquid and the liquid jetting head, stores therein the liquid from the liquid container, and supplies the liquid to the liquid jetting head;

a valve provided on the supplying passage between the liquid container and the pressure chamber so as to open and close the supplying passage; and a negative pressure generating unit that applies a biasing force in a direction along which a distance between opposing inner walls of the pressure chamber is increased, wherein the pressure chamber is a bag-shaped member that is formed of a resin material, of which wall surface is displaced accompanying a change in a liquid amount stored inside, wherein the pressure chamber is mounted in a carriage of the liquid jetting head, and a longitudinal direction of the pressure chamber is parallel to a gravitational direction.

8. The inkjet printing device according to claim 5, wherein the pressure chamber is provided therein with a plate-shaped member having a higher rigidity than the resin material.

9. The inkjet printing device according to claim 5, wherein the pressure chamber is disposed in the casing through a first adhering portion.

10. The inkjet printing device according to claim 9, wherein the negative pressure generating unit adheres to the pressure chamber through a second adhering portion opposing the first adhering portion.

* * * * *